US005920296A

United States Patent [19]

Garcia

[11] Patent Number: 5,920,296

[45] **Date of Patent: *Jul. 6, 1999**

[54] FLAT SCREEN HAVING INDIVIDUALLY DIPOLE-PROTECTED MICRODOTS

[75] Inventor: Michel Garcia, Les Milles, France

[73] Assignee: Pixel International, Rousset, France

[ * ] Notice: This patent issued on a continued prosecution application filed under 37 CFR 1.53(d), and is subject to the twenty year patent term provisions of 35 U.S.C. 154(a)(2).

[21] Appl. No.: 08/892,165

[22] Filed: Jul. 14, 1997

Related U.S. Application Data

[63] Continuation of application No. 08/256,916, Feb. 1, 1995, abandoned.

[51] Int. Cl.[6] ..... G09G 3/22

[52] U.S. Cl. ..... 345/74; 257/10; 313/500

[58] Field of Search ..... 345/74, 75, 92; 323/315; 357/23; 313/483, 498–500; 257/221, 403, 10; 327/419, 427

[56] References Cited

U.S. PATENT DOCUMENTS

| | | | |
|---|---|---|---|
| 4,302,764 | 11/1981 | Fang et al. | 357/23 |
| 4,727,309 | 2/1988 | Vajdicetal | 323/315 |
| 4,999,812 | 3/1991 | Amin | 365/185 |
| 5,407,852 | 4/1995 | Ghio et al. | 437/48 |
| 5,508,421 | 4/1996 | Palmour | 257/77 |
| 5,585,301 | 12/1996 | Lee et al. | 313/306 |
| 5,585,673 | 12/1996 | Tomil et al. | 313/308 |

FOREIGN PATENT DOCUMENTS

| | | |
|---|---|---|
| 0492585 | 7/1992 | European Pat. Off. . |
| 0496572 | 7/1992 | European Pat. Off. . |
| 4112078 | 10/1991 | Germany . |

*Primary Examiner*—Amare Mengistu
*Assistant Examiner*—Ricardo Osorio
*Attorney, Agent, or Firm*—Arthur L. Plevy

[57] ABSTRACT

A flat screen field emission cathode is disclosed including microtips individually protected by means of a series electrical coupling with a dipole consisting of a depletion mode field effect transistor. The current-voltage characteristic of such a dipole is not linear. These dipoles can be obtained such that the protection threshold and current emission level, and therefore the brilliance of the screen, can be altered globally (on all tips at once) solely by acting on the biasing of the substrate common to these dipoles, or groups of dipoles.

4 Claims, 1 Drawing Sheet

FLAT SCREEN HAVING INDIVIDUALLY DIPOLE-PROTECTED MICRODOTS

This is a continuation of application Ser. No. 08/256,916, filed on Feb. 1, 1995 now abandoned, entitled, FLAT SCREEN HAVING INDIVIDUALLY DIPOLE-PROTECTED MICRODOTS.

BACKGROUND OF THE INVENTION

1. Field of the Invention

It is generally related to the field of flat display or visual screen having matrix addressing of any size, and can be applied in any industrial sectors using screens of this type: television, computer, telecommunications, monitoring devices, surveillance equipment.

2. Description of the Prior Art

Known microtip screens are vacuum tubes generally constituted of two, imperviously sealed, thin glass plates, the rear plate or cathode plate comprising a matrix network of field effect emitters consisting of microtips, and the front plate or anode plate being covered by a transparent conducting layer and luminophores.

Each luminous point (pixel), is associated with an oppositely located cathodic emitting surface and constituted of a large number of microtips (approximately 10,000 per mm2). This emitting surface is defined by the intersection of a line (grid) and a column (cathodic conductor) of the matrix.

By virtue of the short tip-grid distance ($\leqq 1\ \mu m$) and the amplifying effect of the tip, a potential difference of less than 100 volts applied between line and column enables the obtention, at the top of the tip, of an electric field that is sufficient to cause the emission of electrons and high luminance with a low voltage luminophore.

The conventional structure of the cathode of a microtip screen especially comprises, deposited successively on a substrate of glass or silicon:

an insulation layer;

a resistive layer of silicon or other material;

"column conductors" constituted of a metallic layer which can be deposited either beneath or above the resistive layer;

an insulating layer (Si or SiO2) which constitutes the grid insulator;

a metallic layer which constitutes the grid or line conductors.

After depositing the aforementioned layers, holes in which the microtips are then produced, are drilled into the insulating grid by means of known etching techniques.

The main object of the resistive layer is to limit the current in each emitter in order to homogenize the electronic emission, and to limit the maximum current which would pass through the tip in case of a tip-grid short-circuit.

The load characteristic which results from serializing a resistance with the tip, is a straight line. The voltage drop in this resistance is proportionate to the current which passes through it and can be quite substantial if the current emitted by the dot is substantial. The voltage which must be applied to the protective tip-resistance system is increased proportionately, which substantially affects the screen consumption, in particular.

The object of the present invention is a flat screen having individually dipole-protected microtips.

SUMMARY OF THE INVENTION

The device according the present invention proposes to resolve these problems. Indeed, it not only enables an efficient limitation of the current passing through each microtip to be obtained by self-adjustment of the emission current beyond a threshold, even if the tip is in direct contact with the grid, but also a better emission homogeneity, as well as an efficient and simplified control of screen luminance.

It is constituted of a flat screen field emission cathode comprising microtips individually protected by means of a series electrical coupling with a dipole consisting of a depletion mode field effect transistor. The current-voltage characteristic of such a dipole is not linear. These dipoles can be obtained such that the protection threshold and current emission level, and therefore the brilliance of the screen, can be altered globally (on all tips at once) solely by acting on the biasing of the substrate common to these dipoles, or groups of dipoles.

BRIEF DESCRIPTION OF THE DRAWING

In the annexed schematic drawings, provided as a non-limiting example of one of the embodiments of the object of the invention.

DETAILED DESCRIPTION OF THE DRAWING

Figure 1:
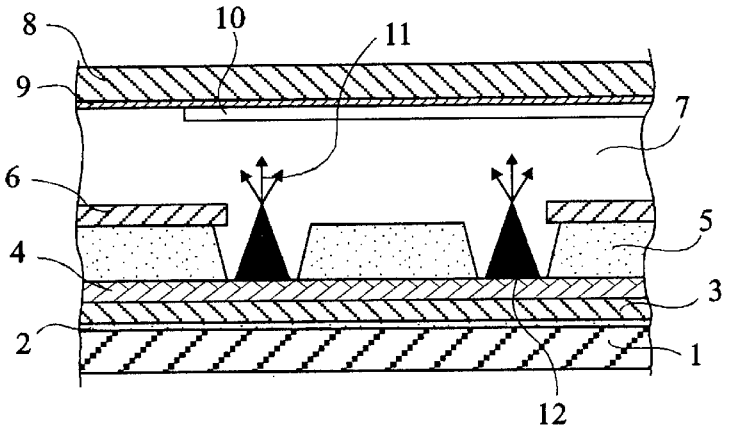
Fig 1 (PRIOR ART)
FIG. 1 is a transverse section illustrating the functioning principle of a know microtip screen.

The basic principle of a microtip screen is illustrated in FIG. 1, which shows, successively from bottom-to-top (in practice from rear-to-front):

A glass or silicon plate 1, a coating underlayer 2, cathodic conductors or column conductors 3, a resistive layer 4, an insulating layer 5, a line or grid conductors 6, a hollow space 7 and a front glass layer 8 covered on its internal surface with a transparent conducting layer constituting anode 9 and luminophores 10.

An electron beam 11, emitted under vacuum by microtips 12, which are electrically connected to the cathodic conductors and modulated by the potential of grid 6, is accelerated in the direction of anode 9 where it energizes luminophores 10 (triode-type functioning). Focusing is obtained by proximity effect without any electronic optics by virtue of the short tip-anode distance.

Figure 2:
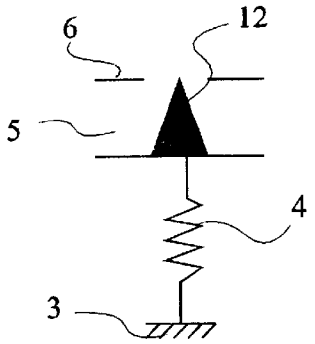
Fig 2 (PRIOR ART)
FIG. 2 is an elementary symbolic diagram of a microtip of FIG. 1.
Figure 3:
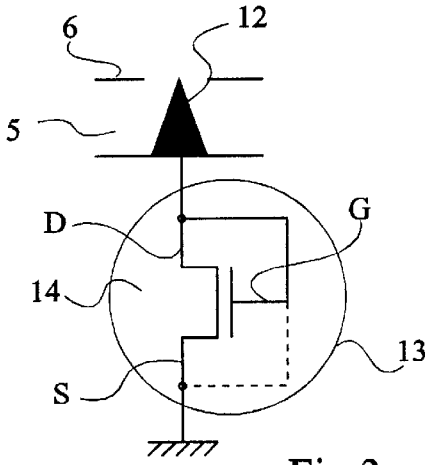
FIG. 3 is an elementary symbolic diagram of a microtip individually protected by a dipole.

In this type of cathode, each microtip 12 is protected against excess current by the serialization of a load resistor 4 (FIG. 2). This resistance is generally constituted by a resistive layer 3 (FIG. 1) of resistant amorphous silicon (or other material).

In an emitting cathode according to the invention, the protection of each microtip 12 is no longer obtained by serialization of a load resistor, but by serializing a dipole 13 whose voltage-current characteristic is not linear. This dipole is constituted of a field effect transistor (FET) 13, having an insulated depletion gate G, a drain D connect to microtip 12, and a source S connected to the corresponding column conductor 3, the gate G of each transistor being directly connected either to source S or drain D.

By totally blocking the current in the lip, this arrangement enables microtip 12 to be protected completely against direct short-circuits between tip and grid 6.

Dipoles 13 are advantageously manufactured by integrated technology, on a single silicon substrate (massive or a thin layer), such that by biasing said substrate, capable of being common to all dipoles 13, the protection threshold and the emission current level (modulation of the brilliance of the screen) can be altered globally (on all tips at once).

Figure 4:
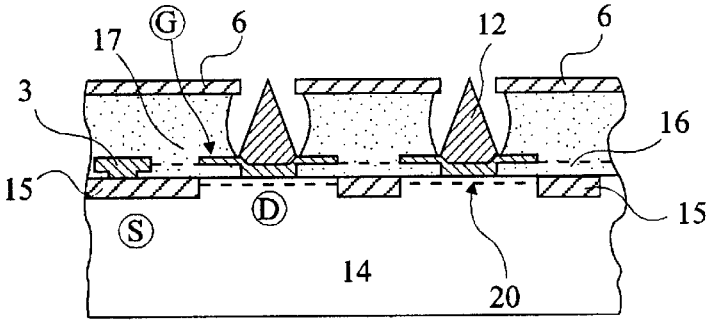
FIG. 4 represents the transverse section of a microtip-emitting cathode according to the invention.

As an example, FIG. 4 shows a partial section of an emitting cathode having microtips protected by dipoles formed in a P-type substrate 14, in which over-doped N-type zones 15 are obtained by diffusion or other (implantation) and constitute the sources of a depletion transistor. Channel 20 is formed, for example, by an ionic N-type implantation. A silica gate insulation layer 16 is obtained by surface oxidizing or deposit. Gate electrode 17 is created at the same time as column conductor 3, by metallization. The tip is produced in the usual manner, but rests on the gate of the transistor. Preferably, the drains located beneath the microtips are not over-doped, as is usual in conventional MOS structures.

Figure 5:
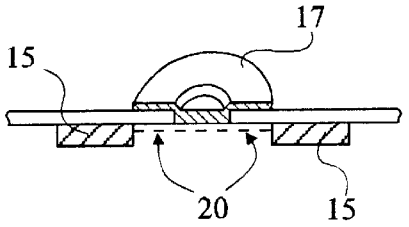
FIG. 5 is a perspective partial section showing the channel of the field effect transistor around the microtip.

The field effect transistor constituting dipole 13 can advantageously have a circular geometry, its conduction channel 20 being located entirely around microtip 12 (FIGS. 4 and 5).

Thus, dipole 13 functions as follows. The extraction voltage is applied on electrode 6 (grid). When this voltage is low (sufficiently low so that the tip/source voltage is less than the threshold of the depletion transistor), the dipole in series with tip 12 is approximately equivalent to the resistance of implanted channel 20, its value is fairly low. When the extraction voltage increases such that the tip/source voltage is of the order of, or greater than, the threshold of said depletion transistor, pinch gate 17 does its job and "pinches" channel 20, limiting the current in the dipole to a value (saturation current of the depletion transistor) which, primarily, now only depends upon the geometric dimensions of the assembly and the voltage of substrate 14 with respect to source 15. The loss of voltage in the dipole itself no longer depends on the current in the tip, but only on the threshold voltage of said depletion transistor. In fact, each tip will be blown by the saturation current of the depletion transistor which protects it. Since the geometries of said transistors are identical, the currents in the tips (regardless of the particular emission characteristics of the tips) will be identical.

The emitting cathode can itself be produced on silicon by integrated technology. In this case, column conductors 3 and possibly the line conductors (or grid 6) can be constituted of diffused layers, embedded or not, with the alternative of doubling, here and there, the layer diffused by metallization (positioned in a non-encumbered sector for example, or, so as to minimize the coupling capacities).

The positioning of the various constituent elements provides the object of the invention with a maximum of useful effects which, to date, have not been obtained by similar devices.

I claim:

1. A flat microtip screen including a silicon layer of a first conductivity type, comprising:

a plurality of first regions of a second conductivity type having a high doping level formed in said silicon layer and connected with a cathode conductor;

a second region formed in said silicon layer, adjacent to each of said first regions, said second region being of said second conductivity type and having a low doping level, wherein said second region is coated with an insulating layer having an aperture defined therein which exposes a portion of said second region, wherein the exposed portion of said second region comprises a drain region, and wherein the portion of said second region covered with said insulating layer comprises a channel region;

a conductive layer extending across each insulating layer and filling said aperture to coat said exposed portion of said second region; and a microtip formed above said conductive layer above said aperture.

2. The flat microtip screen of claim 1, wherein each of said apertures, said microtips, said conductive layers, said first and second regions are concentric.

3. The flat microtip screen of claim 1, wherein said column conductors are regions diffused in said silicon layer.

4. A flat microtip screen including a silicon layer of a first conductivity type, comprising:

a plurality of first regions of a second conductivity type having a high doping level formed in said silicon layer and connected with a cathode conductor constituting source regions;

a second region formed in said silicon layer, said second region comprising a central portion constituting a drain region and a peripheral portion relative to said drain region constituting a channel region, adjacent to each of said first regions, said drain region and said channel region each being of said second conductivity type and having a low doping level relative to said first regions, wherein said second region is coated with an insulating layer having an aperture defined therein which exposes a portion of said second region and wherein a conductive layer extends across each of said insulating layers and fills each of said apertures to coat said exposed portion of said second region; and a microtip formed above each of said conductive layers above said apertures.

* * * * *